US009556669B2

(12) United States Patent
Lombardini

(10) Patent No.: US 9,556,669 B2
(45) Date of Patent: Jan. 31, 2017

(54) CUSHION FOR SHADING SYSTEM

(71) Applicant: PLASTEX SA, Madonna del Piano (CH)

(72) Inventor: Marco Lombardini, Vernate (CH)

(73) Assignee: PLASTEX SA, Madonna del Piano (CH)

( * ) Notice: Subject to any disclaimer, the term of this patent is extended or adjusted under 35 U.S.C. 154(b) by 0 days.

(21) Appl. No.: 14/405,630

(22) PCT Filed: May 29, 2013

(86) PCT No.: PCT/IB2013/054436

§ 371 (c)(1),
(2) Date: Dec. 4, 2014

(87) PCT Pub. No.: WO2013/182956

PCT Pub. Date: Dec. 12, 2013

(65) Prior Publication Data

US 2015/0167382 A1 Jun. 18, 2015

(30) Foreign Application Priority Data

Jun. 5, 2012 (CH) ..... 776/12

(51) Int. Cl.
*A47H 3/00* (2006.01)
*E06B 9/17* (2006.01)
(Continued)

(52) U.S. Cl.
CPC . *E06B 9/38* (2013.01); *E06B 9/40* (2013.01); *E06B 9/582* (2013.01)

(58) Field of Classification Search
CPC ..... E06B 9/58; E06B 9/582; E06B 9/581; E06B 2009/587
See application file for complete search history.

(56) References Cited

U.S. PATENT DOCUMENTS 4,610,293 A * 9/1986 Weiblen ..... E06B 7/02 160/120
5,479,979 A * 1/1996 Hayashiguchi ..... E04F 10/0607 160/265
(Continued)

FOREIGN PATENT DOCUMENTS

DE 8802780 5/1988
DE 9406851 6/1994
(Continued)

OTHER PUBLICATIONS

International Search Report from International Application No. PCT/IB2013/054436 mailed Oct. 7, 2013.

*Primary Examiner* — Katherine Mitchell
*Assistant Examiner* — Jeremy Ramsey
(74) *Attorney, Agent, or Firm* — Dorsey & Whitney LLP

(57) ABSTRACT

The invention describes a cushion for shading system of the type comprising a piece of cloth slidingly fastened to a section bar of an upright. A raceway with a substantially C-shaped cross section serves to fasten the cushion to a section bar edge, and a flexible plastic tongue, having an end on the raceway and an opposed end spaced therefrom in order to contact the upright, serves as a spring between the section bar and the upright, allowing the section bar to come nearer to the upright in a compression phase or to be spaced in a predetermined way in the absence of compression.

15 Claims, 9 Drawing Sheets

(51) Int. Cl.

| | |
|---|---|
| ***E06B 9/38*** | (2006.01) |
| ***E06B 9/40*** | (2006.01) |
| ***E06B 9/58*** | (2006.01) |

(56) References Cited

U.S. PATENT DOCUMENTS

| | | | | | |
|---|---|---|---|---|---|
| 5,716,155 | A * | 2/1998 | Yoshida | B62D 23/005 | 403/187 |
| 7,793,702 | B2 * | 9/2010 | Biewer | B60J 7/0007 | 160/272 |
| 8,602,081 | B2 * | 12/2013 | Komatsu | E06B 9/13 | 160/273.1 |
| 8,607,841 | B2 * | 12/2013 | Hayashiguchi | E06B 9/581 | 160/273.1 |
| 2014/0076507 | A1 * | 3/2014 | Dibben | E06B 9/58 | 160/272 |

FOREIGN PATENT DOCUMENTS

| | | | | |
|---|---|---|---|---|
| DE | 202009002343 | | 7/2010 | |
| FR | 2430512 | | 2/1980 | |
| GB | 2502039 | A * | 11/2013 | E06B 9/58 |
| JP | H0780570 | | 3/1995 | |
| JP | 2004211298 | | 7/2004 | |
| JP | 2004211299 | | 7/2004 | |
| SE | WO 2012050518 | A1 * | 4/2012 | E06B 9/40 |
| WO | WO 2012/050518 | | 4/2012 | |

* cited by examiner

CUSHION FOR SHADING SYSTEM

FIELD OF APPLICATION

The present invention relates to a cushion for shading system of the type comprising a piece of cloth sliding in a pair of uprights, associated to or incorporated in the frame of a window to be shaded; the cushion is inserted in the uprights, in order to deaden the wind effect which tends to move sharply the piece of cloth between the uprights. The invention also relates to a cushion system comprising the above-mentioned cushion and to a section bar whereto the cushion is fastened. The invention also relates to a particularly advantageous upright section bar, whereon the cushion is to be assembled.

PRIOR ART

It is known that a shading system comprises a piece of cloth suitable to shade an opening, for example a piece of cloth made of plastic material or fabric, connected to a cord or rod in order to be withdrawn from the opening, allowing the light to get through, or lying along it, for shading. The shading system opening and closing is for example a rolling gate, in which case the piece of cloth is sliding in a pair of guide uprights, associated to a frame or incorporated therein.

In general, guide uprights are perpendicular to the floor and the piece of cloth appears vertically sliding; there is nothing to prevent the uprights from being horizontal and the piece of cloth horizontally sliding. More particularly, opposed sides of the piece of cloth are inserted in section bars, preferably plastic ones and known per se, which form the piece of cloth guide in the upright. Substantially, the section bar has the same length as the upright and it is retained in a thickness of the upright with a predetermined play, which favours the horizontal movement of the piece of cloth.

Known shading systems are quite noisy, especially when they are lying, due to the fact that the piece of cloth can be knocked down by air draughts which tend to move it sharply between the uprights, causing the section bars to bang against them. What has been said above appears evident from FIGS. 1 and 1*a*, related to a detail of a section bar A (FIG. 1) and to a front cross section thereof (FIG. 1*a*). The section bar A, as said above, is fastened in the upright of a window frame and it comprises a seat S for an edge or side of the piece of cloth; during the assembly, the piece of cloth edge appears slidingly insertable in the seat S through an opening E of the section bar, letting the rest of the piece of cloth coming out of the seat S (and of the upright) through a fissure B of the section bar, which has a width being lower than the piece of cloth edge, in order to retain the edge in the seat S. The opposed edge of the piece of cloth is similarly associated to a section bar of the other frame upright. When the air acts on the piece of cloth surface, the piece of cloth moves the section bar which, as said above, is coupled to the upright with a predetermined play, causing it to bang against it.

On the other side, keeping the piece of cloth in tension between the uprights, for example by rigidly fastening the section bar to the uprights, without leaving any movement margin to the section bar in the uprights, in the attempt to prevent the piece of cloth from waving under the action of the wind, is not an effective solution, since in the long run the wind damages the piece of cloth or it loosens anyway the coupling thereof with the section bar, and it spoils the shading system.

Cushion systems are also known, which comprise a little sponge C or a plurality of little sponges stuck along the section bar, in order to cushion the impact of the section bar against the upright.

However, in these shading systems too it is necessary to leave some movement margin to the section bar in the upright, which prevents an optimal tension of the piece of cloth, also in the absence of wind. Moreover the little sponges are wearing, which causes the detaching thereof from the section bar or the loss of effectiveness in deadening the stroke against the upright. Moreover, the application thereof is quite difficult, especially when carried out by hand.

The technical problem underlying the present invention is to think up a cushion for shading system which is very simple to realize and simple to apply to the section bar, also mechanically, which is capable to effectively reduce the noise caused by the section bar movement in the upright, avoiding the piece of cloth to be damaged due to the opening, closing and adjusting operations of the shading system or to the action of the wind, but also allowing an optimal tension of the piece of cloth, both in wind condition, and in the absence thereof, being finally cheap, and overcoming the limits and drawbacks still affecting known shading systems.

SUMMARY OF THE INVENTION

The idea underlying the present invention is to apply on the section bar of a shading system a plastic cushion which prevents the direct contact between the section bar and a respective upright, the cushion comprises a tongue with an end turned towards the upright, preferably always in contact therewith, and an opposed end fastened on a cushion raceway which appears applicable to the section bar, for example insertable by fast coupling on a section bar edge.

The tongue is flexible. At rest, for example in the absence of wind, the tongue is lying between the section bar and the upright, and in operating conditions, for example when the wind pushes the section bar towards the upright, it is deformed between them, preventing the contact therewith.

More particularly, according to an embodiment of the present invention, the tongue is straight in rest conditions. For example, the tongue at rest is perpendicular to the raceway and it is curved when it is compressed between the upright and the section bar, in operating conditions. According to an alternative embodiment, the tongue is always straight at rest but it has a predetermined angle with respect to the raceway or with respect to a frame contact surface. Without limiting the scope of protection of the invention, the raceway has a C-shaped cross section, it is equipped with a bottom and two side walls with a predetermined length, and the tongue is formed on a side wall, for example coplanar to the bottom, preferably on the whole length of the raceway. Alternative embodiments are provided, in which the tongue is perpendicular to the side wall but not coplanar to the bottom or in which the tongue does not cross the whole length of the raceway.

The Applicant has also thought up an upright suitable to cooperate with the cushion and to improve the flexion of the tongue. In particular, the upright is preferably made of aluminium and it is equipped with a curved outline suitable to facilitate the curvature of the tongue towards the raceway, in the compression step of the plastic outline on the upright, thus preventing the tongue from bending in an undesirable direction.

According to another aspect of the invention, the tongue has a predetermined curvature also in rest conditions and it is deformed between the upright and the section bar in operating conditions, assuming a different curvature.

The tongue is pre-loaded due to a predetermined shape and/or dimensional factor, in order to space the section bar from the upright, in the absence of wind, which allows the cloth to be tightened between the uprights, and it is also flexible, with shape memory, in order to allow the section bar to be brought nearer to the upright, under the action of the wind, preventing sudden movements thereof.

In an aspect of the invention, the cushion is shaped as a spring clip, and it is applicable by shape coupling to the section bar; for example, the cushion raceway is snap inserted in the section bar and the tongue has an end on the raceway and an opposed end turned towards the upright. Preferably, the tongue is extruded or co-extruded enbloc with the raceway.

According to this aspect of the invention, the cushion is directly applicable on an upright section bar and the flexible tongue is turned towards the upright and it serves as a spacer. A plurality of cushions are applicable along a single section bar, in order to cushion the contact with the respective upright, along the whole upright; in particular, the section bar has the same length as the upright and it is associated to and it keeps slidingly a first edge of the piece of cloth in the upright. A plurality of cushions are applicable on the section bar of the opposed upright of the window, which is coupled to the other edge of the piece of cloth.

According to this solution idea, the above-explained technical problem is solved by a cushion for shading system of the type comprising an upright section bar along an opening to be shaded, characterized in that it comprises a raceway with a substantially C-shaped cross section, suitable to be fitted, preferably snap inserted, on a section bar edge, and a plastic tongue having an end on the raceway and an opposed end spaced therefrom, at least one portion of said tongue being flexible, in order to cushion the contact between the upright and the section bar. Advantageously, the upright and the section bar never come into contact with each other and the stresses, exerted by the wind or by the user on the piece of cloth during the shading system closing or opening, are discharged on the flexible tongues, which come nearer to the raceways without however coming into contact therewith.

According to several aspects of the present invention, in the absence of compression, the plastic tongue can be straight or sloping with respect to the raceway or curved. The plastic tongue is elastically deformable and outside the raceway.

According to an aspect of the invention, a raceway bottom has a predetermined width and two raceway sides are convergent from the bottom towards the opening of the C-shaped cross section, in order to realize a pressing contact on the section bar edge, the parties being assembled. Advantageously, according to this aspect of the invention, the cushion is firmly fixed to the section bar edge since it is insertable until the raceway bottom abuts against the edge and it is kept by the sides which press on the section bar surface. To this purpose, the sides are advantageously flexible and with shape memory, and they exert a predetermined pressure on the section bar.

According to another aspect of the invention, at least one of the sides comprises a flange with a tip turned towards the bottom of the raceway, which hooks in one thickness of the section bar delimiting a groove.

Preferably, the insertion of the flange into the groove is by snapping. For example, the flange is associated to a distal portion of the side which delimits the C-shaped opening, and it is flexible in order to bend towards the side during the insertion of the raceway in the section bar. Advantageously, the flange improves the coupling between the cushion and the section bar and it keeps the correct positioning thereof, when being used.

According to a preferred aspect of the invention, one side of the raceway is substantially perpendicular to the bottom and the other side, till more preferably the side with the flange, is sloping towards the opening of the C-shaped cross section, and it reduces the width thereof at rest. According to this aspect of the invention, the tongue end belonging to the raceway is associated to the side being perpendicular to the bottom. Advantageously, according to this structure, a distal portion of the tongue applied to a section bar appears substantially parallel to an upright surface and it provides a supporting surface, on which cushion is made.

Even more particularly, the tongue end is associated to an end of the side and the opposed tongue end is substantially aligned with the other end of the side, when the tongue is at rest. During the contact with the upright, said opposed tongue end, which forms the supporting surface, bends towards the side.

The raceway has preferably a length L of about 2 cm. The opposed tongue end at rest, is about 1 cm away from the side. There is nothing to prevent the size from being different, however not changing the solution idea on which the invention is based.

To this purpose, the Applicant has noticed that with a cushion system comprising a plurality of cushions of the above-described type, and assembled with a predetermined pitch on a section bar of a shading system, for example with a pitch comprised between 5 cm and 15 cm, surprising results are obtained in terms of quietness of the shading system.

According to another aspect of the present invention, which concerns the cushion composing material, the Applicant has noted a particular advantage in using polypropylene with an extrusion method.

The above-explained technical problem is also solved by a cushion system according to the present invention comprising a plurality of cushions of the above-described type, assembled with a predetermined pitch on an edge of an upright section bar. Preferably, these cushions are assembled on two opposed edges of the section bar and the latter is equipped with a rib, between the two edges, having a fissure for housing a piece of cloth edge. The pitch of the cushions on the edges is predetermined, preferably at 5-15 cm.

According to an aspect of the invention, the section bar edge whereon the cushion raceway is fitted comprises a portion of reduced thickness serving as a raceway draft and a groove for hooking the tip of the cushion flange, preferably for a snap insertion.

The technical problem is also solved by a section bar for a frame upright, comprising an edge insertable in a cushion raceway and characterized in that the edge has a portion of reduced thickness which serves as a raceway draft, preferably said reduced thickness being lower or equal to the opening of the raceway C-shaped cross section at rest and the remaining edge portion having a thickness being higher or equal to the opening of the C-shaped cross section at rest, said section bar delimiting a longitudinal groove, preferably in correspondence with said remaining portion, suitable to receive by snapping the tip of the raceway flange in order to hook the raceway to the section bar. The section bar is preferably equipped with opposed edges with respect to a central rib in which the piece of cloth is fastened and, the edges are suitable to house a plurality of cushions. According to this embodiment, the reduced edge facilitates and speeds up the assembly of the cushions on the upright section bars.

Further features and advantages of the cushion and section bar of the system according to the present invention will be apparent from an embodiment thereof, given only by way of not limiting example with reference to the attached figures.

DETAILED DESCRIPTION

Figure 1A:
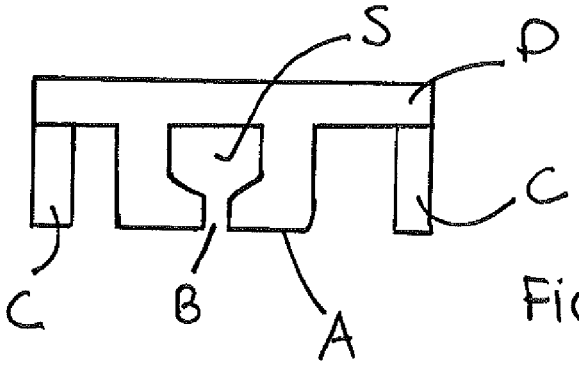
FIG. 1*a* is a front cross section of the section bar of FIG. 1.
Figure 1:
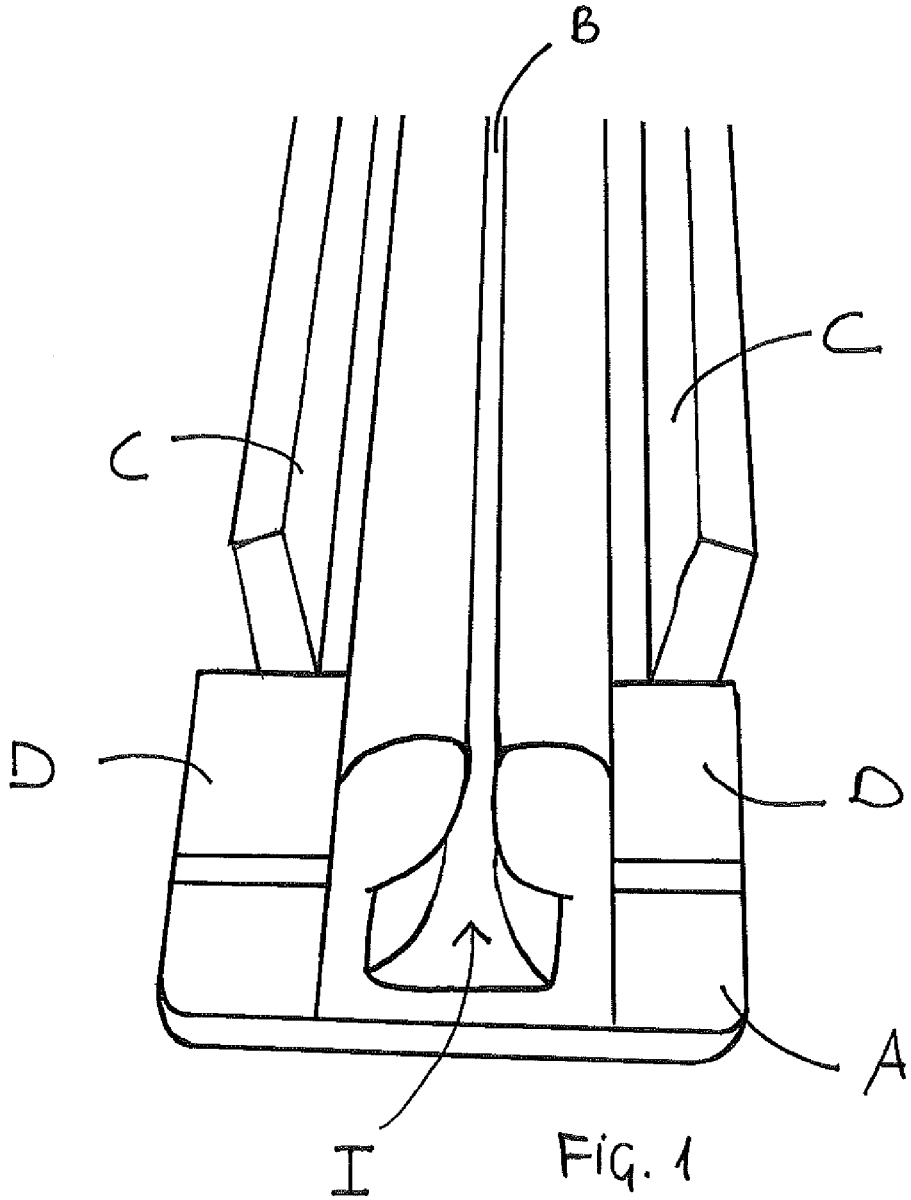
FIG. 1 is a detail of a section bar with a little sponge according to the prior art.
Figure 2:
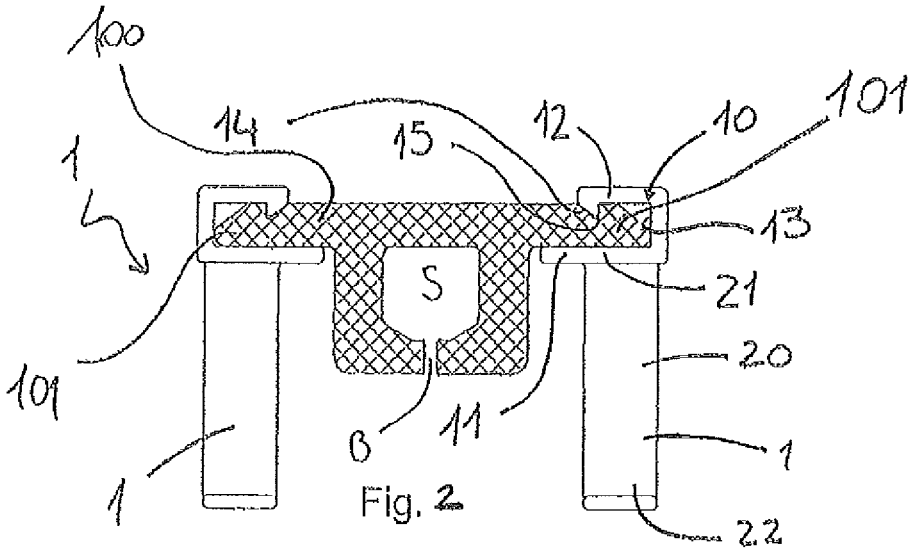
FIG. 2 is an assembled front cross section of a section bar and of two cushions, according to the present invention.

FIG. 2 is cross-sectional view of two cushions 1, according to the present invention, applied to a section bar 100 of an upright, for example an upright integrated in a frame of a window to be shaded, substantially having the same length as the window. The section bar 100 is a longitudinal element substantially of the same length as the upright and it has a seat S for an edge of a shading piece of cloth which comes out of the section bar 100 and of the respective upright through a fissure B of the section bar. The piece of cloth edge remains in the seat for example since it has a higher thickness than the width of the fissure B, preventing the piece of cloth from detaching from the section bar. Another section bar 100 is associated to an opposed frame upright.

Figure 3:
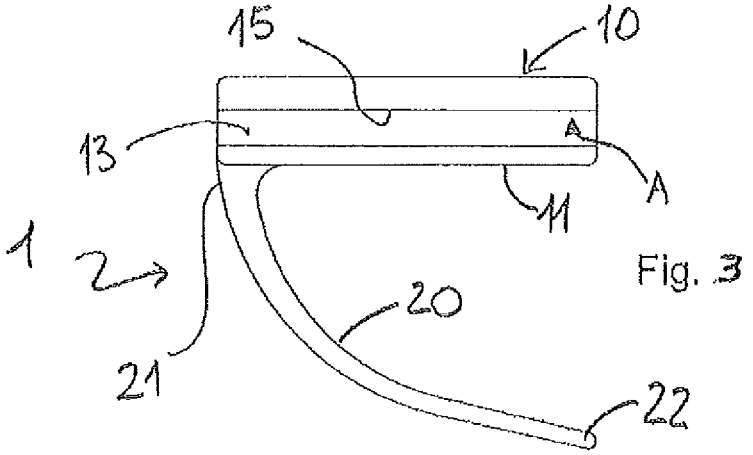
FIG. 3 is a side view of the cushion of FIG. 2.
Figure 4:
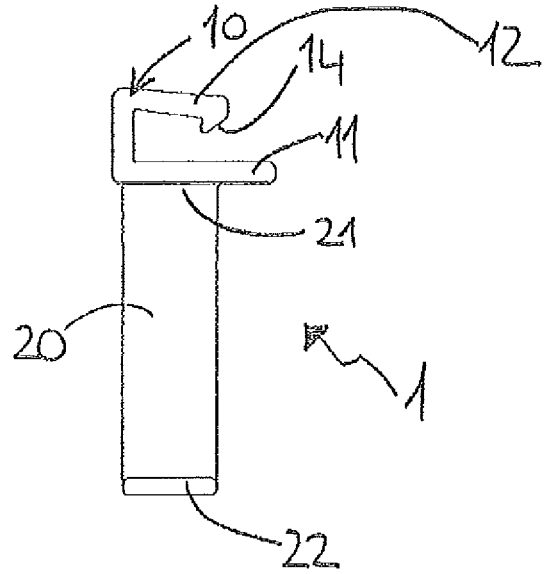
FIG. 4 is a detail of the cushion of FIG. 2.

According to the invention, the cushion 1 comprises a raceway 10, also indicated in FIGS. 3-4, with a substantially C-shaped cross section which serves to fasten the cushion to a section bar edge 101, and a flexible plastic tongue 20 and with shape memory, having an end 21 on the raceway and a opposed end 22 spaced therefrom in order to remain in contact with the upright; the tongue serves as a spring between the section bar and the upright, allowing the section bar to come nearer to the upright in the compression step or to be spaced in a predetermined way in the absence of compression.

The tongue extends outside the raceway. According to different embodiments of the cushion, it is provided that the tongue extends in the direction along which the shading piece of cloth is intended to extend or in the opposite direction.

Figure 5:
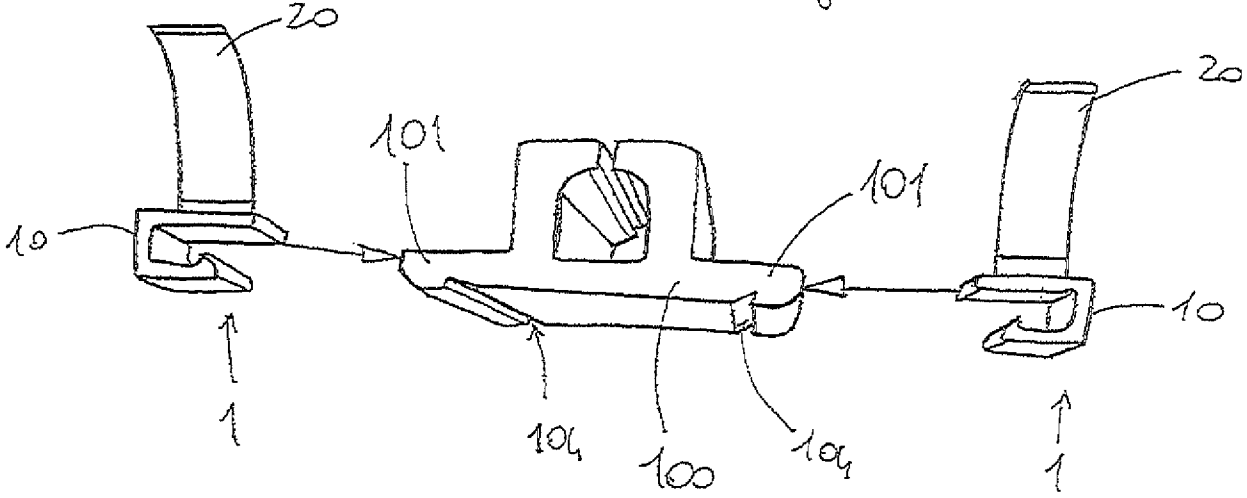
FIG. 5 is an exploded perspective view of the section bar and of the cushions of FIG. 2.
Figure 6:
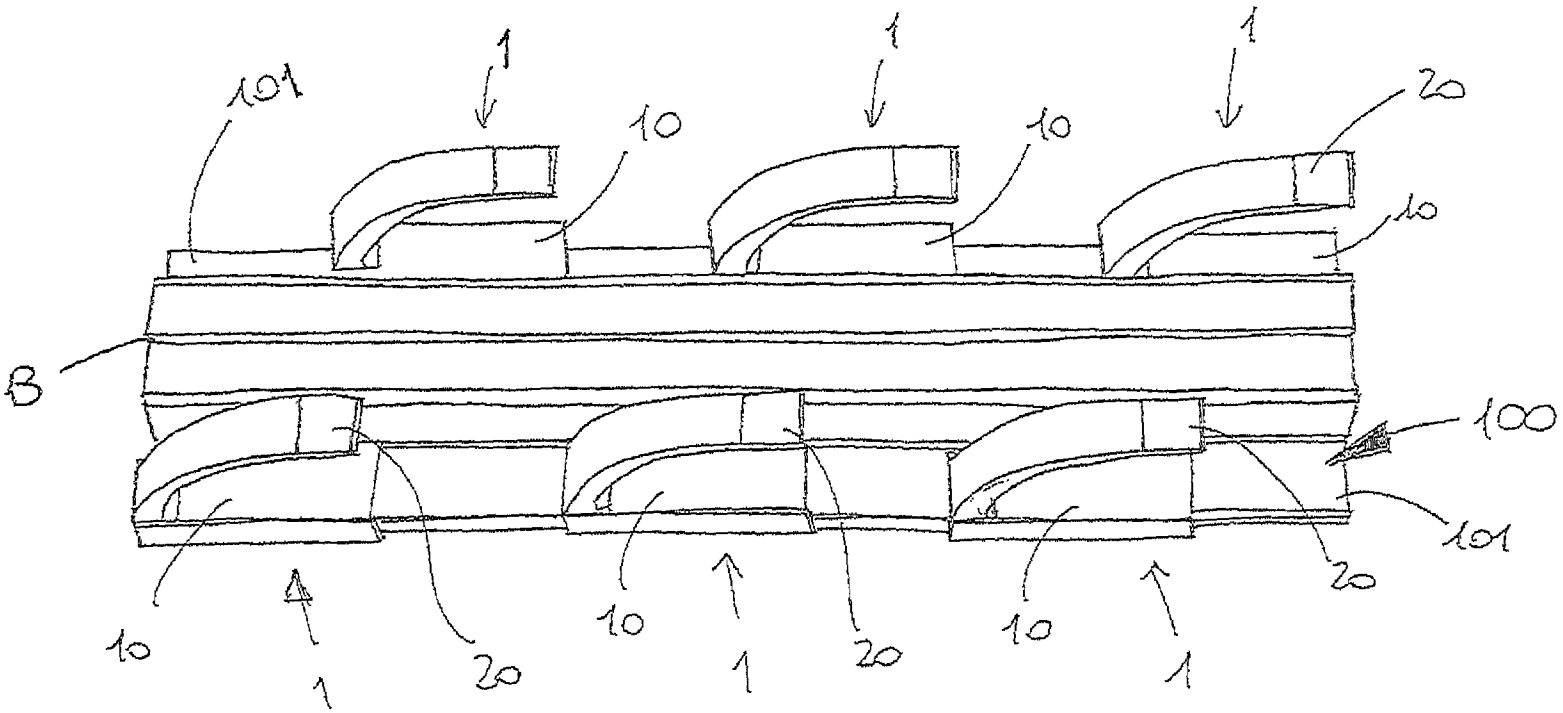
FIG. 6 is a different perspective view of the section bar and of a plurality of cushions, according to the present invention.

Substantially, the shape and/or the size of the tongue represents a pre-load of the tongue which spaces not only the end 22 from the raceway but also the section bar from the upright, when assembled. This aim is improved by the application of a plurality of cushions, as represented in FIG. 6, preferably on opposed sides or edges of the section bar, with respect to fissure B. For example, each raceway is about 2 cm long and a plurality of cushions are fitted through the respective raceways on the section bar, with a pitch of 10-15 cm. FIG. 5 schematically shows the detached parts, i.e. two cushions 1 suitable to be fitted on opposed edges 101 of the section bar 100.

According to an aspect of the invention, a bottom 13 of the raceway 10, for example indicated in FIGS. 2 and 3, has a predetermined width B and two sides 11, 12 of the raceway are preferably convergent from the bottom 13 towards the opening of the C-shaped cross section, in order to make a pressing contact on the section bar, i.e. on a supporting surface thereof. A flange 14 with a tip 15 turned towards the bottom 13 is provided on one side 12, which hampers the section bar going out of the raceway 10. To this purpose, a groove 104 is provided in a thickness of the section bar (FIG. 5) suitable to receive by snapping the flange 14 of the raceway.

Figure 8:
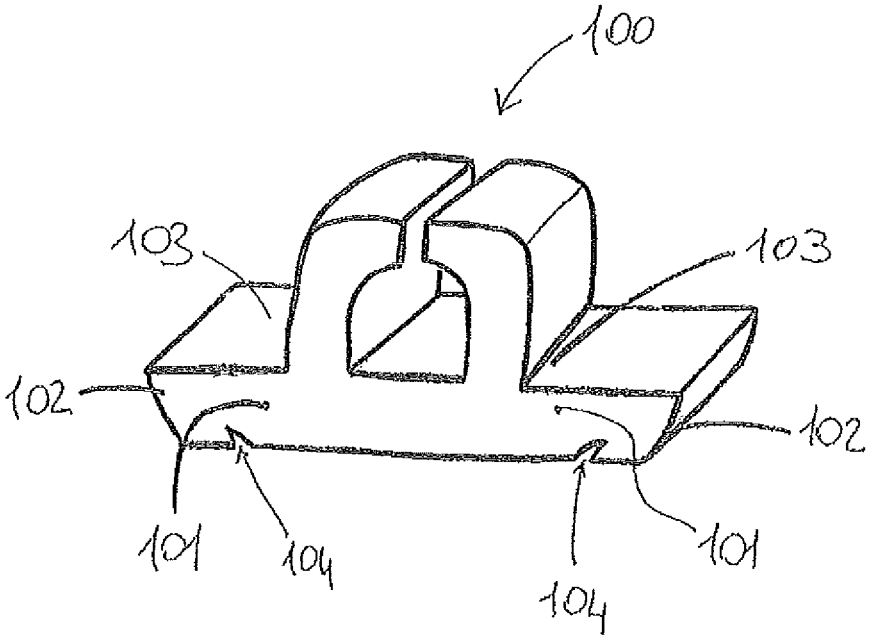
FIG. 8 is a perspective view of the section bar according to the present invention.
Figure 7:
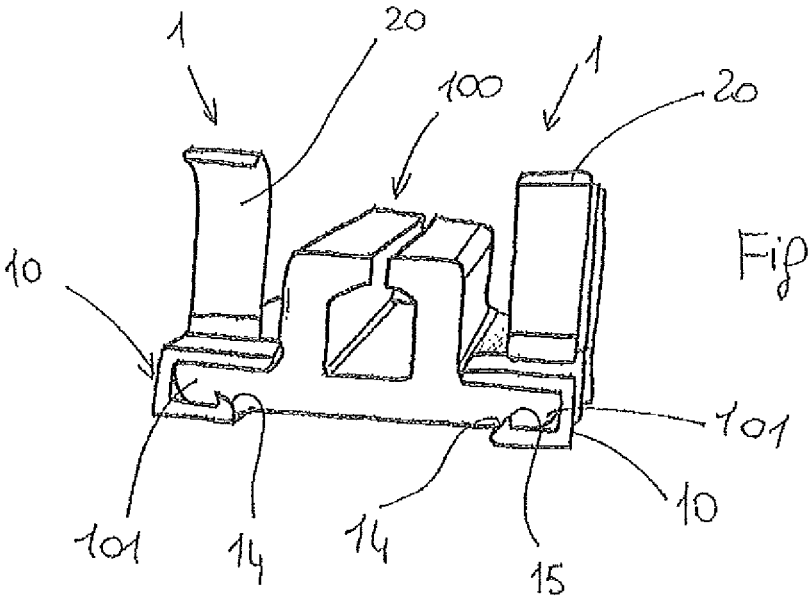
FIG. 7 is a further perspective view of the section bar and of the cushions of FIG. 6.

The Applicant has also devised an advantageous section bar which allows the cushions to be applied automatically, rapidly and cheaply, as schematically represented in FIG. 8. This section bar has an edge 101 whereon the raceway 100 is to be fitted and it comprises a portion of reduced thickness 102 which serves as a raceway draft 10, and a groove for hooking the tip 15 of the flange 14, preferably for snap hooking; the edge 101 of the section bar 100 comprising a remaining portion 103 with a thickness being higher or equal to the opening of the raceway C-shaped cross section at rest. The longitudinal groove 104 is preferably in correspondence with this remaining portion 103.

Preferably the reduced thickness is lower than the opening of the raceway C-shaped cross section at rest, i.e. when it is not fitted on the section bar, and the remaining portion 103 of the edge has a thickness being higher or equal to the opening of the C-shaped cross section at rest. The insertion in the longitudinal groove 104 of the tip 15 of the flange 14 is by snapping.

The portion of reduced thickness 102 is given by rounding off or bevelling the edge 101, preferably on the section bar side concerned by the longitudinal groove 104. According to this aspect of the invention, when the cushion 1 is inserted in the section bar, the side 12 of the raceway 10 engages first the bevelling or rounding 102 and it is brought away from the other side 11, as it engages the portion of increased thickness 103, and until the tip 15 of the flange 14 hooks the groove 104. Such a shape of the section bar allows the cushions to be automatically hooked and, i.e., to be applied by industrial automation, substantially without labour.

Still with reference to FIGS. 2-4, a side 11 of the cushion raceway. 10 is substantially perpendicular to the bottom 13 and the other side 12, preferably the side 12 with the flange 12, is sloping towards the opening of the C-shaped cross section, reducing the width thereof at rest, when it is not applied to the section bar. For example, the end 21 of the tongue 20 belonging to the raceway 10 is associated to the side 11 being perpendicular to the bottom 12. In an embodiment of the invention, the tongue end 21 is associated to an end 24 of the raceway 10 and the opposed end 22 of the tongue 20 at rest is substantially aligned with the other end 25 of the raceway 10.

Figure 9:
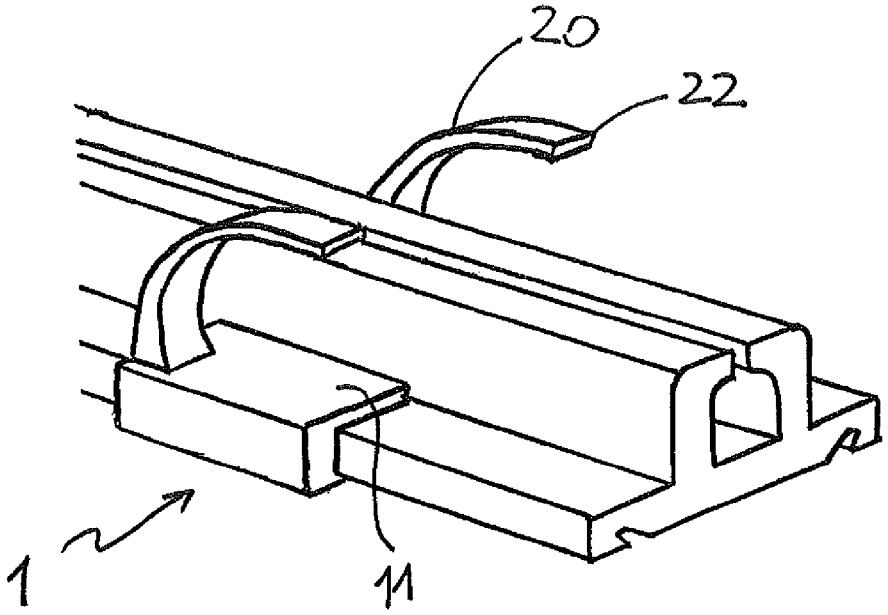
FIG. 9 is an image of the section bar and of two cushions according to the present invention.
Figure 10:
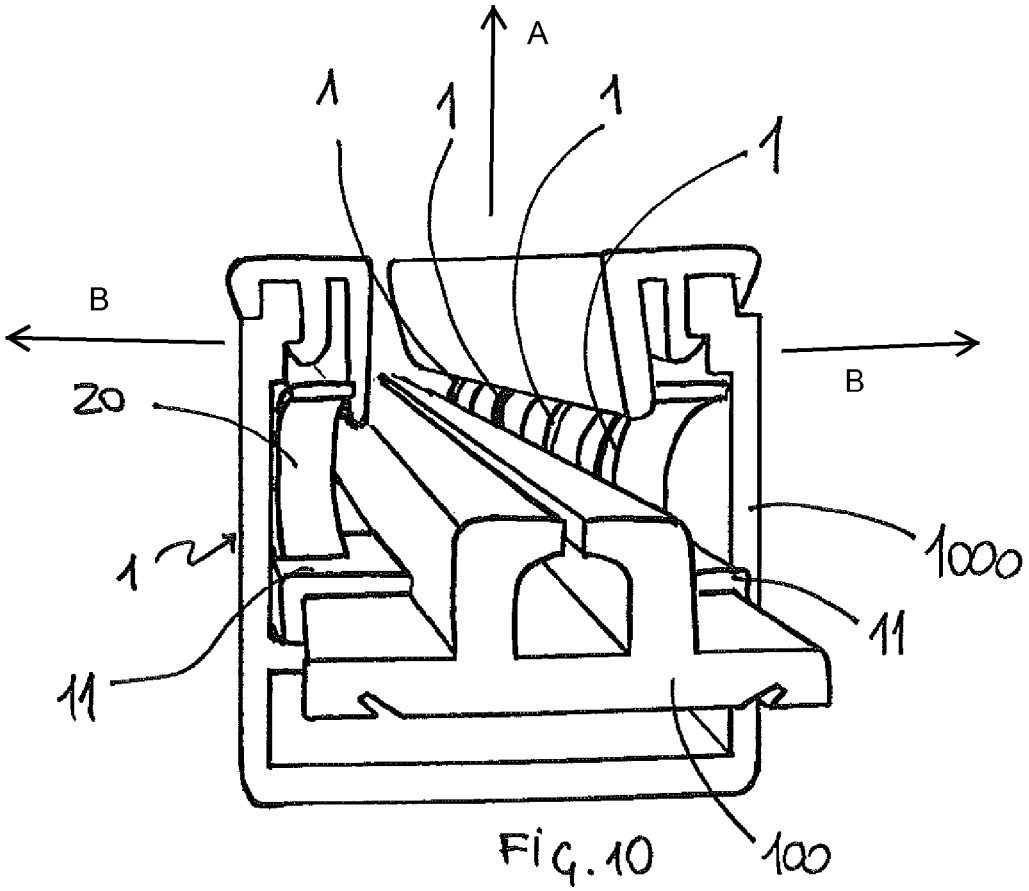
FIG. 10 is an image of the section bar and of the cushions of FIG. 2, inserted in an upright.
Figure 11:
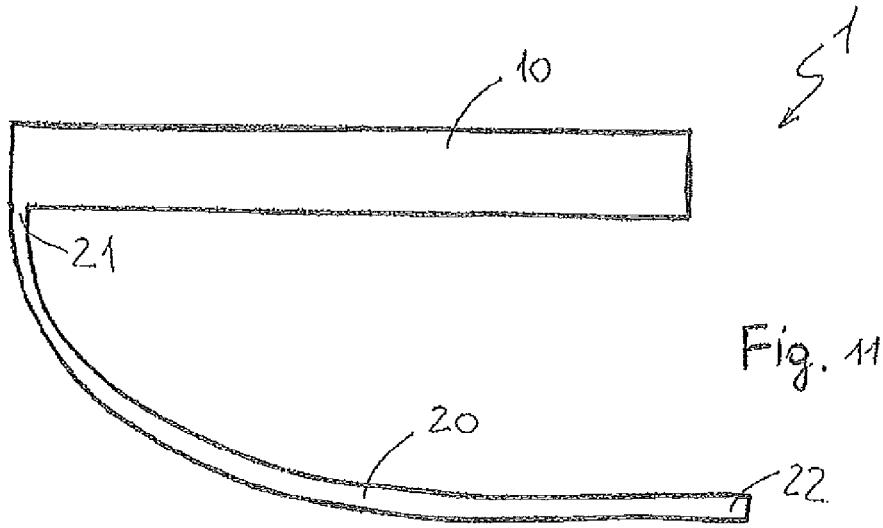
FIGS. 11-14 are different side, front and perspective views of the cushion of FIG. 3.
Figure 12:
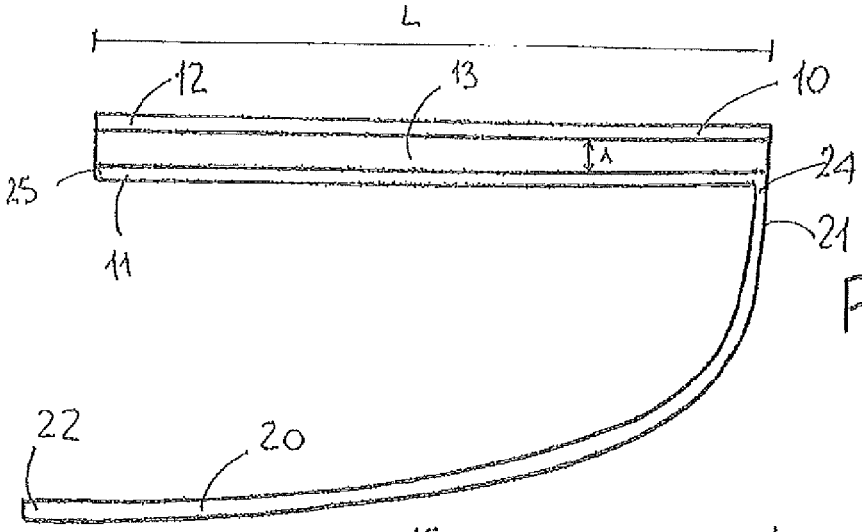
Figure 13:
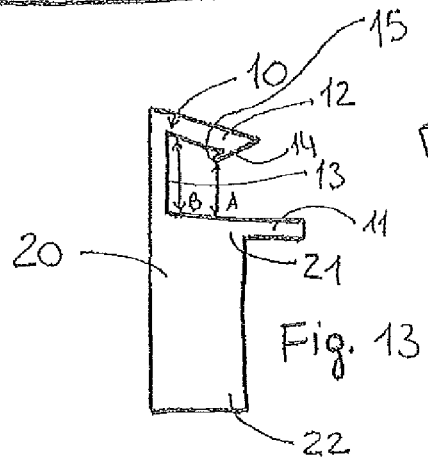
Figure 14:
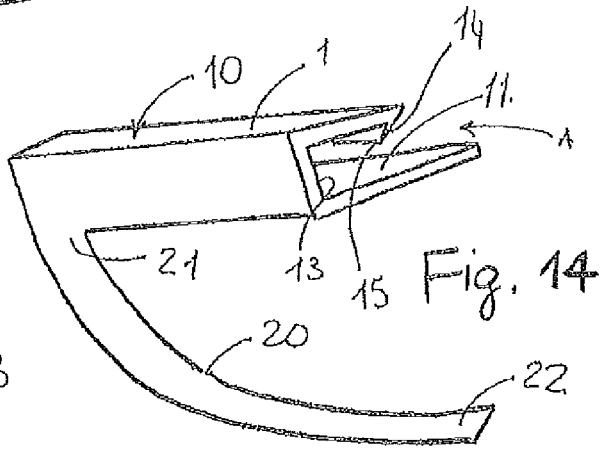

FIG. 9 is an image of a section bar portion on which two cushions are already fastened and FIG. 10 is an image of this section bar inserted in the thickness of an upright 1000. As it can be noted, the end 22 of the tongue 20 contacts the upright 1000 or it is very close in order to carry on at once the spring function if the piece of cloth (not represented) drags the section bar 100 towards the upright.

With reference to FIGS. 15*a*-15*d* some embodiments of the plastic cushion 1 according to the present invention are described, in which the plastic tongue is not curved.

The cushion is applicable to a section bar and it has a tongue 20 with a free end 20*a* suitable to be turned towards the upright, when being used, preferably always in contact therewith, and an opposed end 20*b* on a cushion raceway 10. The raceway 10 appears applicable to the section bar, for example insertable by quick coupling on an edge of the section bar, as already described.

The tongue is flexible. At rest, for example in the absence of wind, the tongue 20 is extended between the section bar and the upright, and in operating conditions, for example when the wind pushes the section bar towards the upright, it is deformed between them, preventing the contact therewith.

More particularly, the tongue is straight in rest conditions (FIG. 15*a*-15*d*). For example, the tongue 20 at rest is perpendicular to the raceway (FIG. 15*a*-15*c*) and it is curved or sloping with respect to the raceway, when it is compressed between the upright and the section bar. According to an alternative embodiment, the tongue is always straight at rest but it has a predetermined angle (FIG. 15*d*) with respect to the raceway 10 or with respect to a frame contact surface (not represented).

Figures 15A, 15B, 15C, 15D:
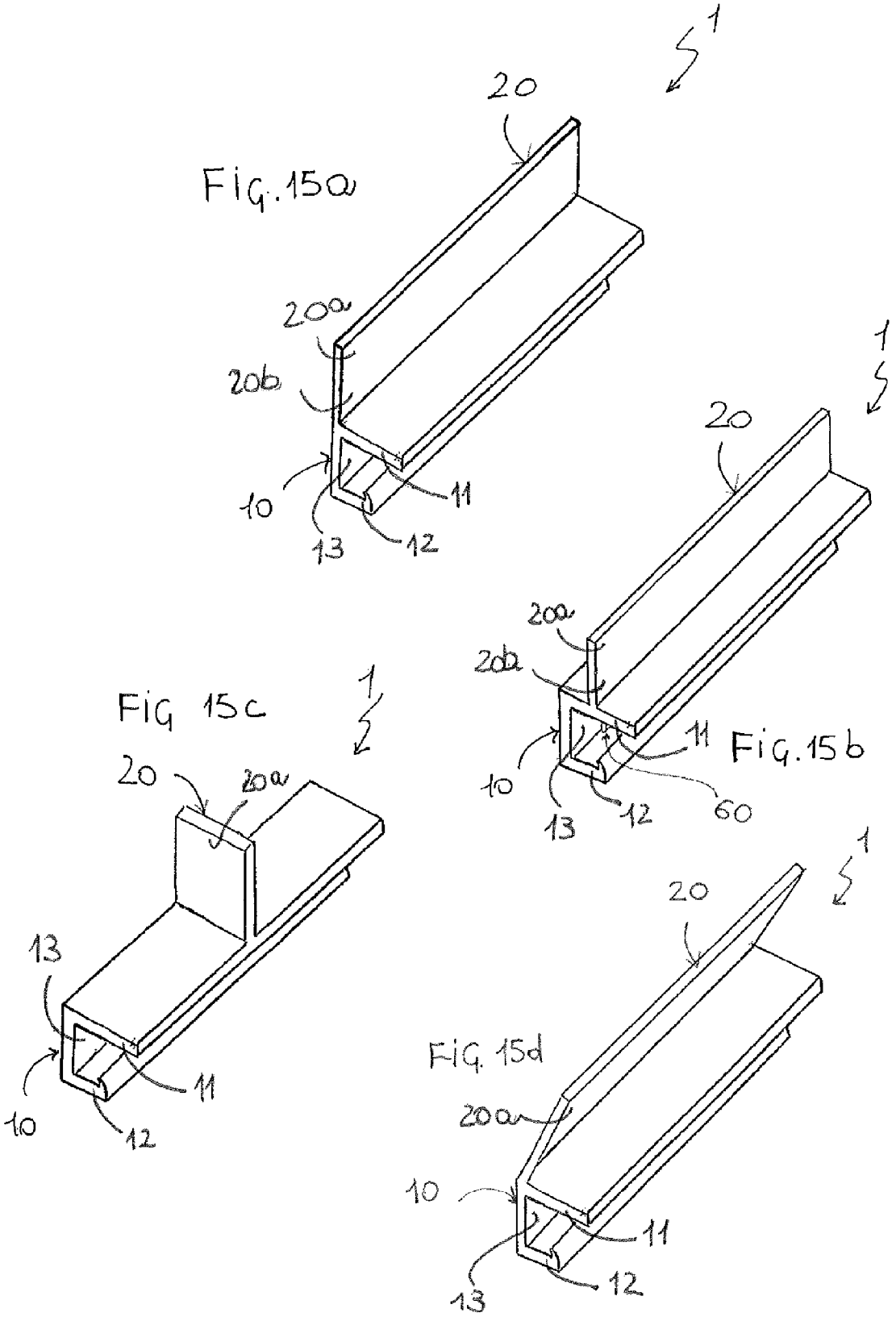
FIGS. 15*a*-15*d*, 16, 17 are different embodiments of the cushion according to the present invention.

The raceway has a C-shaped cross section, and it is equipped with a bottom 13 and two side walls 11, 12 of predetermined length, and the tongue 10 is formed on a side part 11, for example coplanar to the bottom 13, preferably on the whole length of the raceway 10 (FIG. 15*a*, 15*b*, 15*d*). Some alternative embodiments are provided, in which the tongue 10 is perpendicular to the side wall 11 but not coplanar to the bottom 13 or in which the tongue 20 does not cross the whole length of the raceway 10.

In a preferred embodiment, for example represented in FIG. 15*b*, a protrusion or pin 60 is formed under one side 11 of the raceway 10, suitable to be inserted in a section bar hole, as represented in FIG. 15*b* by way of example. The pin 60 increases the hold of the raceway on the section bar. Moreover, multiple holes on the section bar, preferably equidistant, allow the hooking positions of the cushions to be predetermined.

Figure 16:
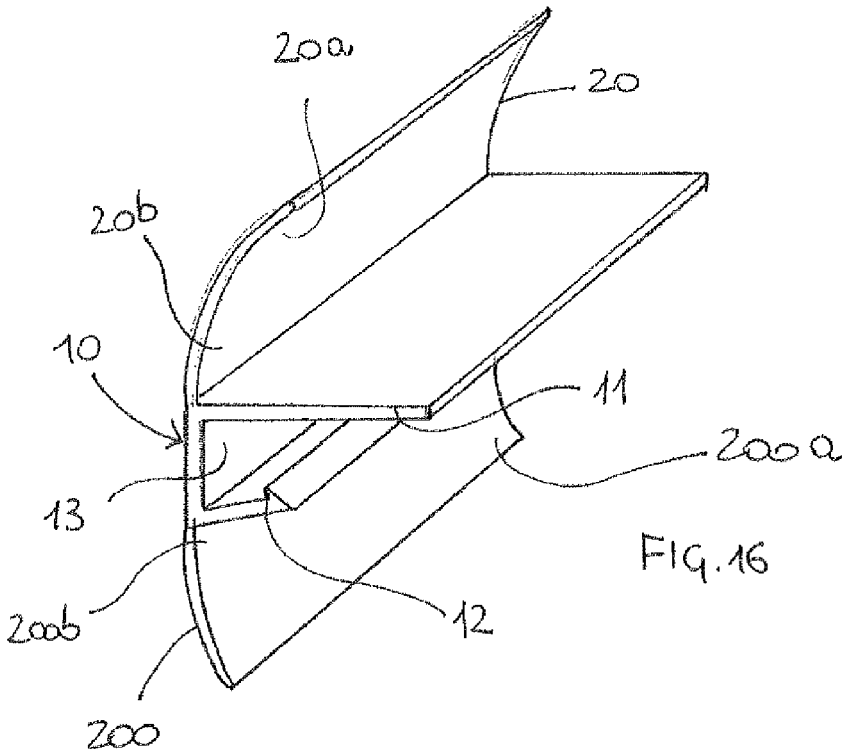
Figure 17:
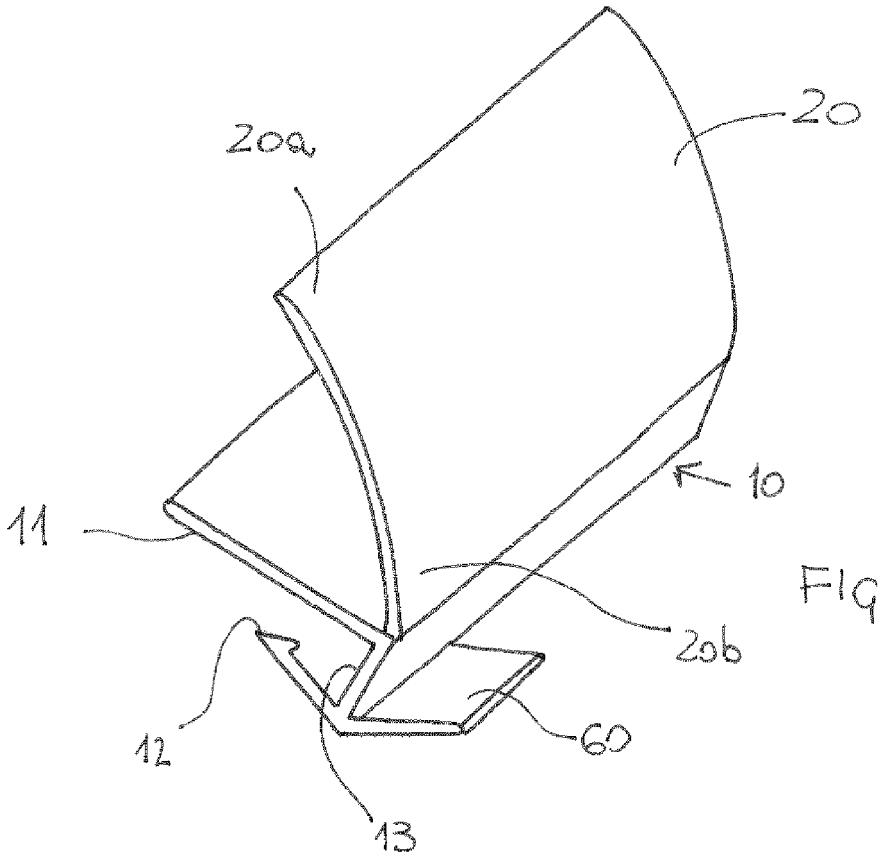

In a particularly advantageous embodiment of the present invention, the raceway has two opposed tongues 20 and 200, substantially extending over and under the raceway 10, outside it, which serve as cushions between the upright and the raceway during opposed movements of the section bar within the upright. In particular, as represented in FIG. 16, a second tongue 200 with an end 200*b* on the raceway and an opposed end 200*a* spaced therefrom, specular on the raceway to the first tongue 20, is intended to contact an upright surface substantially opposed to the upright surface intended to come into contact with the first tongue, and it serves as a spring between the section bar and the upright, allowing the section bar to come nearer to the upright in the compression step or to be spaced in a predetermined way in the absence of compression. Substantially when the first tongue is compressed, the second tongue is extended, and vice versa.

According to this embodiment, the first and second tongue extend in the direction along which the shading piece of cloth is intended to extend and also in the opposite direction. For example, the tongues 20 and 200 are curved at rest.

According to the present invention, on the bottom 13 of the raceway 10, and in particular on the surface of the bottom 13 outside the raceway 10, a plastic fin 60 is formed, which extends along the whole raceway or along a raceway length. The fin 60 serves as a side cushion between the bottom 13 of the raceway 10 and the upright. The fin 60 is particularly useful when the wind strikes perpendicularly the piece of cloth, determining not so much the movement of the piece of cloth between the two uprights (direction A, in FIG. 10) but the movement of the piece of cloth in each of the two uprights (direction B, in FIG. 10). The fin 60 can be realized in any of the embodiments according to the present invention.

The Applicant has also thought up an upright suitable to cooperate with the cushion 1 and to improve the flexibility of the tongue 20. In particular, the upright is preferably made of aluminium and it is equipped with a curved outline suitable to facilitate the curvature of the tongue 20 towards the raceway 10, in the compression step of the plastic section bar on the upright, thus preventing the tongue 20 from bending in an undesirable direction.

The advantages of the cushion of the present invention are the following. The tongue spaces to a predetermined extent the section bar from the upright in the absence of stresses and this predetermined extent corresponds to an optimal tension of the piece of cloth between the uprights, keeping a contact with the upright, through the tongue, which allows the effect of the stresses caused by the wind or by the opening and closing operations on the piece of cloth to be cushioned, which affect the section bar, moving it towards the upright. The tongue spring effect prevents the section bar/upright contact and also sudden movements of the section bar in the upright.

The particular shape of the conceived section bar allows instead the application of the cushions on the section bar edge to be automated and considerably sped up. In fact, the substantially square edge of known section bars forces the raceway to be opened by hand in order to fit the cushion on the edge while the draft of the edge with reduced thickness, being it bevelled or rounded, according to the present invention allows the cushion to be fitted without acting on the raceway: as the raceway is fitted on the edge, the sides thereof are opened wide by the thickening of the section bar edge up to reaching the groove in which the fin is engaged; at this point the sides get nearer again by snapping the one towards the other, fastening to the section bar.

The invention claimed is:

1. A cushion system, comprising:

a plurality of cushions for a shading system, each cushion of the plurality of cushions including:

a raceway having a substantially C-shaped cross section fastening the cushion to an edge of a section bar of the shading system; and a flexible plastic tongue, having an end on the raceway and an opposed end spaced from the raceway to contact an upright of the shading system, said flexible plastic tongue serves as a spring between the section bar and the upright, allowing the section bar to come nearer to the upright in a compression phase or to be spaced in a predetermined measure in the absence of compression;

wherein a first set of the plurality of cushions are assembled with a predetermined pitch on one edge of the section bar and a second set of the plurality of cushions are assembled with a predetermined pitch on an opposed edge of the section bar;

wherein said pitch is a distance between neighboring ones of the plurality of cushions along a longitudinal direction of the section bar;

wherein the cushions of the first set of the plurality of cushions are separated from the cushions of the second set of the plurality of cushions, and each of the plurality of cushions leaves a bottom portion of the section bar free from the raceway.

2. The cushion system according to claim 1, wherein the flexible plastic tongue is substantially straight in the absence of compression.

3. The cushion system according to claim 1, wherein the flexible plastic tongue is sloping with respect to the raceway in the absence of compression.

4. The cushion system according to claim 1, wherein the flexible plastic tongue is curved in the absence of compression.

5. The cushion system according to claim 1, wherein the flexible plastic tongue is elastically deformable.

6. The cushion system according to claim 1, wherein the raceway includes a bottom having a predetermined width and two sides convergent from the bottom towards an opening of the substantially C-shaped cross-section, to realize a pressing contact on the section bar.

7. The cushion system according to claim 6, wherein at least one of the two sides includes a flange having a tip turned towards the bottom, which hampers the section bar going out of the raceway.

8. The cushion system according to claim 7, wherein one of the two sides of the raceway is substantially perpendicular to the bottom, and the other one of the two sides slopes towards the opening of the substantially C-shaped cross-section to reduce the width thereof at rest.

9. The cushion system according to claim 4, wherein the flexible plastic tongue of the raceway includes an end is associated with the one of the two sides that is substantially perpendicular to a bottom of the raceway.

10. The cushion system according to claim 9, wherein the end of the flexible plastic tongue is associated with an end of the raceway, and an opposed end of the flexible plastic tongue at rest is substantially aligned with another end of the raceway.

11. The cushion system according to claim 1, wherein the cushion is made of polypropylene.

12. The cushion system according to claim 1, wherein the raceway is en bloc with the tongue.

13. The cushion system according to claim 1, wherein the raceway has a length of about 2 cm.

14. The cushion system according to claim 1, further comprising a second tongue having an end on the raceway and an opposed end spaced therefrom, the second tongue on the raceway with respect to the flexible plastic tongue, to contact an upright surface substantially opposed to the upright surface intended to come into contact with the flexible plastic tongue, the second tongue serves as a spring between the section bar and the upright, allowing the section bar to come nearer to the upright in the compression phase or to be spaced in a predetermined way in the absence of compression.

15. The cushion system according to claim 1, wherein the section bar includes:

a portion of reduced thickness, which is rounded or bevelled; and a groove for hooking a tip of a flange of the raceway.

* * * * *